United States Patent [19]

Prötzl

[11] 4,073,697

[45] Feb. 14, 1978

[54] IMPACT ABSORBING ATTACHMENT FOR RISER COVER

[75] Inventor: Martin Prötzl, Essen, Germany

[73] Assignee: Didier Engineering GmbH, Essen, Germany

[21] Appl. No.: 732,289

[22] Filed: Oct. 14, 1976

[30] Foreign Application Priority Data

Oct. 22, 1975 Germany ..... 7533508[U]

[51] Int. Cl.[2] ..... C10B 27/06; F16F 15/04

[52] U.S. Cl. ..... 202/254; 202/242; 248/358 R; 267/161

[58] Field of Search ..... 202/242, 248, 246, 254, 202/255, 256, 257, 258, 270; 110/173 R, 173 B; 267/161, 162; 49/381, 383, 141; 248/20, 358 R, 358 AA; 126/194

[56] References Cited

U.S. PATENT DOCUMENTS

| | | | |
|---|---|---|---|
| 2,603,232 | 7/1952 | Keammerer | 202/258 X |
| 3,856,242 | 12/1974 | Cook | 267/162 X |

FOREIGN PATENT DOCUMENTS

| | | | |
|---|---|---|---|
| 2,227,134 | 3/1973 | Germany | 202/242 |
| 397,342 | 2/1966 | Switzerland | 248/20 |

*Primary Examiner*—Morris O. Wolk
*Assistant Examiner*—Arnold Turk
*Attorney, Agent, or Firm*—Wenderoth, Lind & Ponack

[57] ABSTRACT

A riser cover is fixed to a shaft which is rotated in bearing projections of a bearing member which is attached to a the cover is absorbed and damped before it is transmitted to the riser. Shock absorbing elements, preferably in the form of plate springs, are positioned between the bearing member and a supporting device of the riser.

17 Claims, 7 Drawing Figures

IMPACT ABSORBING ATTACHMENT FOR RISER COVER

BACKGROUND OF THE INVENTION

The present invention relates to a riser for a coke oven of the type employed to remove the fill gases from a cokeoven chamber into a collecting main, and specifically of the type including a raisable cover for closing an opening in the corner area of the riser, such cover being mounted on a shaft on a supporting device of the riser.

Riser covers typically have a diameter approximately equal to the diameter of the riser. Since the risers have a relatively large diameter of, e.g. 70 cm, the covers are of necessity quite heavy. Consequently, considerable forces result when the cover is opened, and such forces must be absorbed by the riser. The corner element of a riser, through which the fill gases rising from the oven chamber are guided into the collecting main and wherein the opening is provided, is ordinarily made in the form of a casting due to its shape. On such cast corner element there is also formed the supporting device for the shaft on which the cover is mounted. Thus, when the cover is opened or closed, the forces of reaction to the acceleration or retardation of movement of the cover must be absorbed by the cast corner element. It has been observed that cracks are formed in the cast corner element due to such forces being transmitted thereto when the cover is rapidly accelerated and retarded. This can be explained as resulting from transmitting sudden and large shocks to the cast corner element.

SUMMARY OF THE INVENTION

The object of the present invention is to provide an improved manner of mounting the cover on the riser so that impacts or shocks due to sudden movement of the cover are not directly transmitted in an undamped and/or irregular manner to the riser, in particular the corner element thereof, but rather are transmitted thereto only after being substantially damped or depressed.

The above object is achieved according to the present invention in that the cover together with the shaft is mounted in bearing projections or paws which are part of an independent bearing member, and that the bearing member is attached to the supporting device by means of at least one intermediate element which absorbs or damps the impact resulting from opening of the cover. Thus, an impact acting on the shaft or the cover is not transmitted through the bearing projections directly to the supporting device formed on the riser. Rather, such impact is absorbed by the intermediate element between the bearing member and the supporting device.

The cover mounting system is preferably constructed in such a manner that a counterweight and an impact weight are arranged on an end of the shaft, outwardly from the bearing projections. The counterweight is fixedly and non-rotatably attached to the shaft and has a stop for the impact weight, while the impact weight is rotatably mounted on the shaft, and so that the weights are relatively rotatable with respect to each other within a limited angle. When the cover is closed, the impact weight is positioned at an angle to the counterweight. When the cover is to be opened, the impact weight is accelerated mechanically and strikes the stop of the counterweight. The counterweight is thereby rotated, thus rotating the shaft and opening the cover.

When the cover mounting system is arranged in such a manner, the invention provides for damping or absorbing of the impact force before it is transmitted to the riser.

In a preferred embodiment of the invention, the intermediate elements comprise plate springs, each intermediate element including two plate springs assembled in springing opposition to each other, i.e. facing each other in their respective uncompressed states. The use of plate springs is of advantage, since they are standardized commercially available elements, commonly called Belleville springs and since such elements do not represent a source of danger in the case of flame and heat.

The supporting device and the bearing member are preferably attached to each other by means of connecting screws or bolts, and the intermediate elements are preferably arranged between the connecting screws or bolts, a uniform distribution of forces thus being achieved.

BRIEF DESCRIPTION OF THE DRAWINGS

Further advantages and features of the invention will be apparent from the following detailed description of a preferred embodiment thereof, taken with the accompanying drawings, wherein.

DETAILED DESCRIPTION OF THE INVENTION

Figure 1:
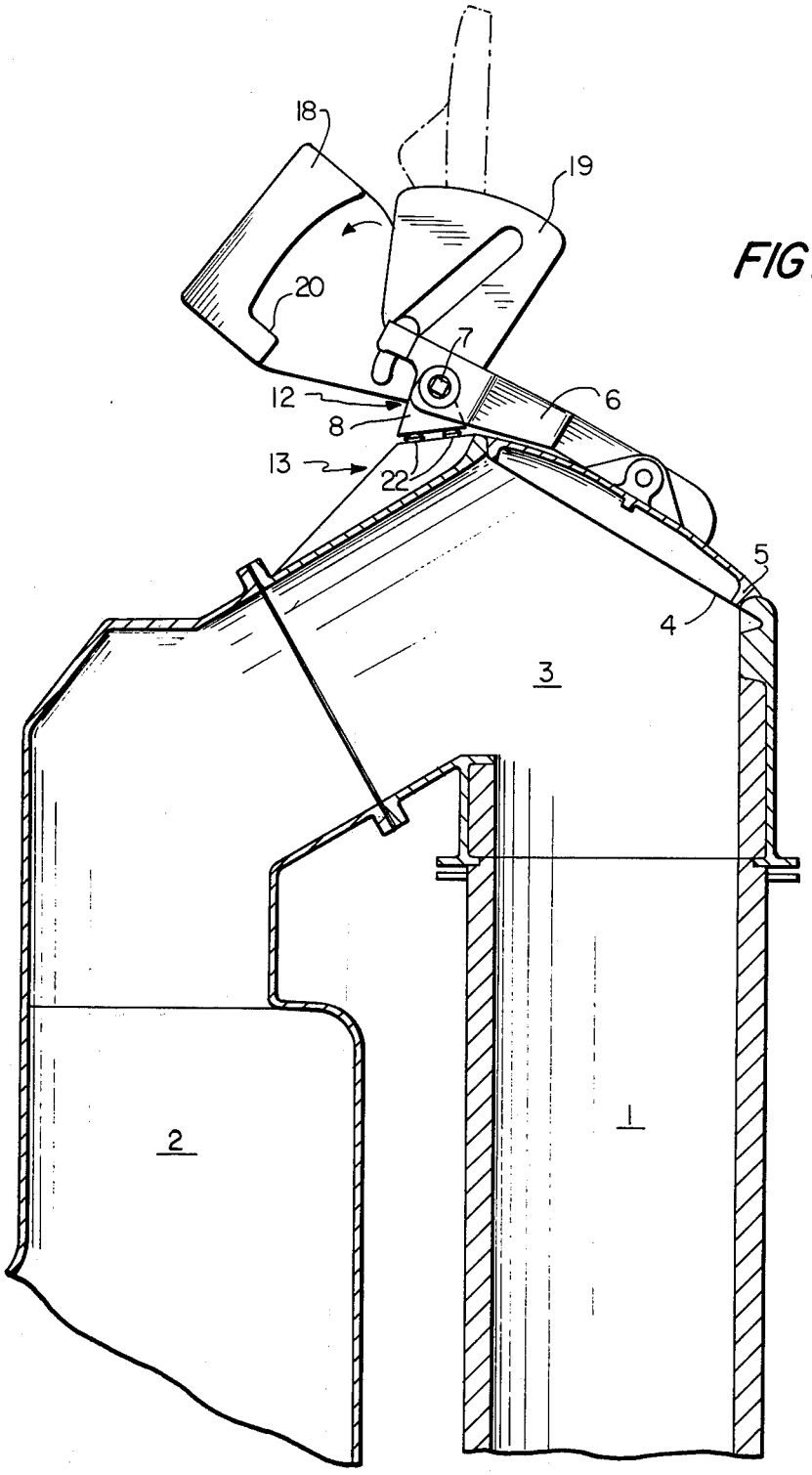
FIG. 1 is a partial section of a riser including a corner element and an impact-operated cover thereon.

A riser 1 has gases of a coke-oven chamber passing upwardly therethrough into a collecting main 2 through a corner element 3. Element 3 has therein an opening 4 which is covered by a cover 5. Cover 5 is normally cemented to the edge of opening 4.

Figure 2:
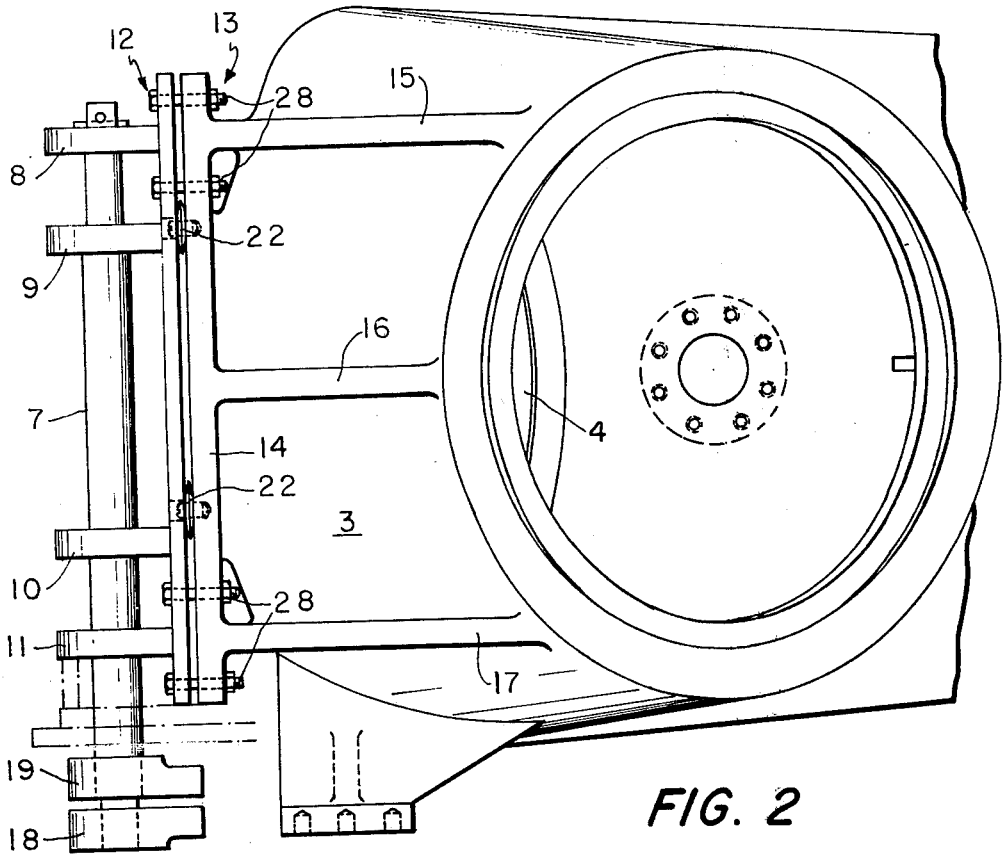
FIG. 2 is a side view of the corner element of the riser, from the left of FIG. 1, and the corner element removed from the collecting main.

Cover 5 is mounted on an end of a cover holder or frame 6, the other end of which is fixedly and non-rotatably attached to a shaft 7, such as by setscrews 7' engaging flat surfaces of shaft 7. Shaft 7 is rotatably supported by a plurality, e.g. four, bearing paws or projections 8, 9, 10 and 11. The above other end of holder 6 is secured to shaft 7 between projection pair 8 and 9 and projection pair 10 and 11, i.e. between projections 9 and 10. The projections are firmly attached to or integrally formed with a cover bearing member 12, which is attached in a manner to be discussed below to a supporting device 13, which is attached to or preferably integrally formed with corner element 3. In a preferred embodiment, element 3 and supporting device 13 are cast as a single element. Supporting device 13 includes a supporting plate 14 attached to corner element 3 by means of three ribs 15, 16 and 17. The distances between ribs 15 and 16 and between 16 and 17 are preferably identical, as shown in FIG. 2. Preferably, outer projections 8 and 11 align with outer ribs 15 and 17, respectively.

On one end of shaft 7 there is fixedly and non-rotatably mounted a counterweight 18. Adjacent counterweight 18, an impact weight 19 is rotatably mounted about the same end of shaft 7. Impact weight 19 can be rotated through the upper dead center thereof by any suitable means, such as the lever mechanism disclosed in German Pat. No. 2,227,134. Such lever mechanism forms no part of the present invention and thus is not illustrated. After impact weight 19 passes its upper dead center, it impacts against a stop 20 of counterweight 18, which then rotates (counterclockwise as shown in FIG. 1) and rotates shaft 7, thereby rotating cover holder 6 and cover 5 and tearing cover 5 loose from the cementing engagement thereof in opening 4. Further opening of cover 5 is effected through the lever mechanism, assisted by weights 18 and 19, in a known manner as disclosed in the above German patent. When cover 5 is fully open, holder 6 abuts with a an abutment surface 21 against bearing member 12.

Figure 3:
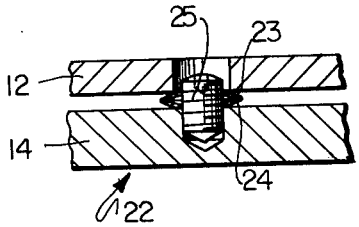
FIG. 3 is an enlarged partial section through an impact-absorbing element of the type shown in FIG. 2.

Supporting device 13, and therefore element 3, are protected from the above impact of the opening of cover 5 in that member 12 is connected to supporting device 13 through shock absorbing intermediate elements 22. In a preferred embodiment, each intermediate element 22 consists of two plate springs 23 and 24 contacting each other in springed opposition and fixed to supporting plate 14 such as by means of screw pins 25, as shown in FIG. 3. Bearing member 12 then rests on the upper plate springs 23.

Figure 4:
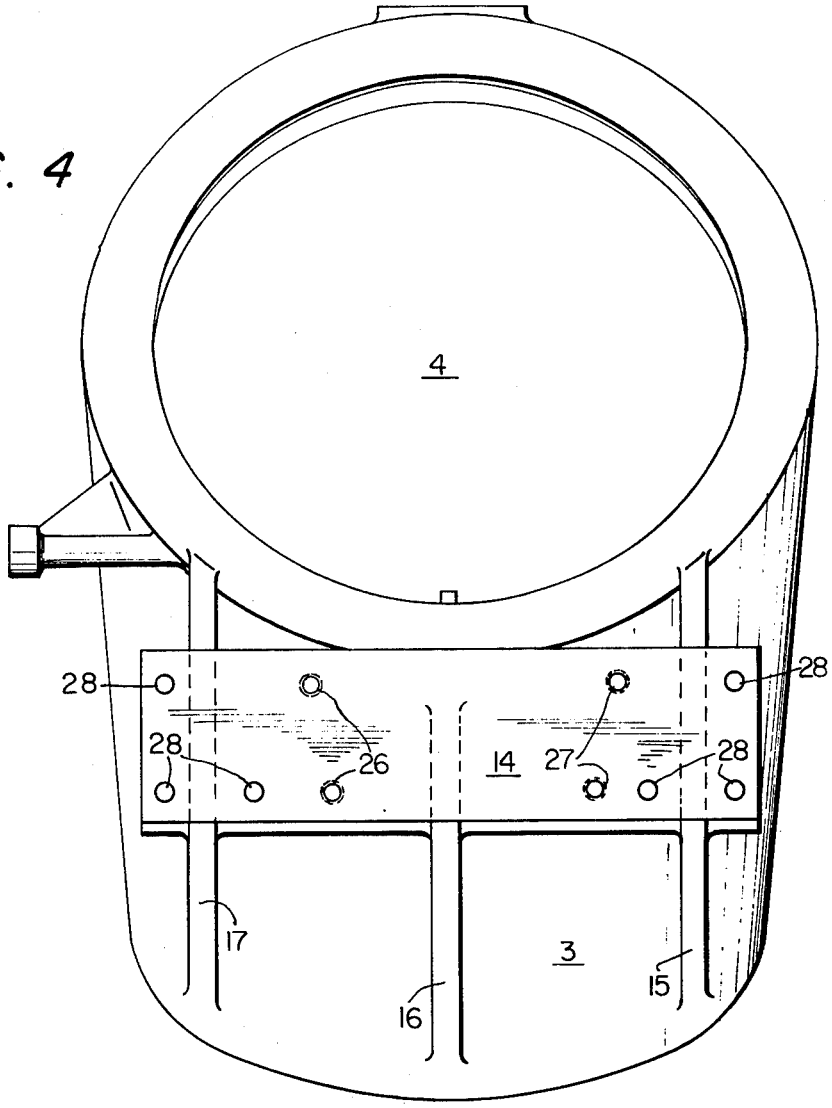
FIG. 4 is a plan view of FIG. 1, but with the cover and cover bearing removed, and illustrating the supporting system for supporting the cover and cover bearing.
Figure 5:
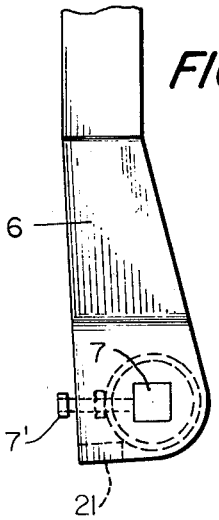
FIG. 5 is an enlarged partial side view of the cover holder of FIG. 1.
Figure 6:
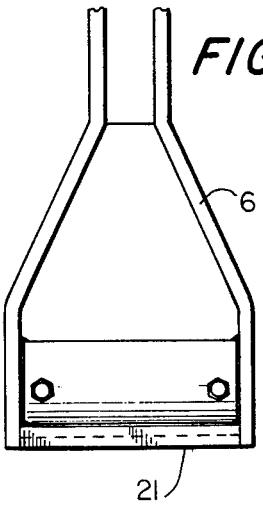
FIG. 6 is a view of the cover holder from the left of FIG. 5 and from the top of FIG. 1.

Totally two pairs 26 and 27 of intermediate elements are arranged between bearing member 12 and supporting plate 14. The two intermediate elements of each pair are shifted in relation to each other, and in the longitudinal direction of shaft 7, to thereby avoid the formation of a weakened cross section, as shown in FIG. 4. Further, pair 26 of intermediate elements is situated approximately midway between ribs 16 and 17. The distance between the pair 27 of intermediate elements and rib 15 is approximately one third of the distance between the ribs 15 and 16. Bearing member 12 is fixed to supporting plate 14 by means of connecting screws or bolts 28, at least some of which are preferably positioned outwardly of ribs 15 and 17 and at least outwardly of intermediate elements 22.

The above described arrangement operates in the following manner.

Figure 7:
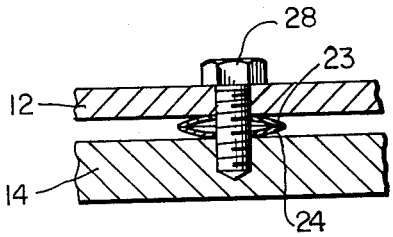
FIG. 7 is a view similar to FIG. 3 of a modified manner of mounting the impact-absorbing element.

When, during an operation to open cover 5, impact weight 19 strikes counterweight 18, there occurs an impact momentum or striking impulse which is transmitted to and must be absorbed by bearing part 12, without transmitting such impact momentum directly to supporting device 13. Specifically, such impact momentum is damped by pairs 26 and 27 of plate springs, and as thus damped, it is transmitted through supporting device 13 and ribs 15, 16 and 17 to impact sensitive corner element 3. Moreover, due to the asymmetrical arrangement of plate spring pairs 26 and 27 with relation to the ribs 15, 16 and 17. The impact momentum proceeding from an end of shaft 7 is uniformly distributed and damped with respect to ribs 15, 16 and 17. The damping of the impact momentum is additionally intensified due to the fact that the free ends of bearing member 12 are vibrated by the impact momentum, such vibration tending to damp the impact momentum. The generation of vibration at the free ends of bearing member 12 can be increased and promoted by arranging connecting screws or bolts 28 transversely through the plate springs, as shown in FIG. 7, in place of pins 25.

When cover 5 reaches its fully opened position, abutment surface 21 impacts bearing member 12, thereby causing another shock, which however is likewise damped by the plate springs, and is transmitted only as thus damped to corner element 3.

The total effect of the above arrangement and operation is reduced stressing of impact sensitive corner element 3 upon opening of the cover 5, so that there is no need to fear the formation of cracks in corner element 3. Moreover, the above arrangement provides the additional advantage that the entire cover-operating device assembly can be simply dismounted, by merely loosening the screws or bolts 28. This is of significant advantage, especially for servicing of the system.

It will be apparent that various modifications may be made to the above specifically described structural arrangement without departing from the spirit and scope of the present invention.

What is claimed is:

1. In a riser for transmitting fill gases from a coke-oven chamber to a collecting main, said riser being of the type including a riser corner element having an opening therein, a cover fixedly mounted on a shaft, said shaft being rotatable to move said cover from a closed position covering said opening to an open position uncovering said opening, and means for rotatably mounting said shaft to said riser corner element, the improvement wherein said mounting means comprises:

a supporting device rigid with said riser corner element;

a cover bearing member separate from said supporting device, said shaft being rotatably mounted in said bearing member; means for attaching said bearing member to said supporting device; and at least one shock absorbing means, positioned between said bearing member and said supporting device, for damping impacts imparted to said bearing member due to opening of said cover.

2. The improvement claimed in claim 1, wherein said shock absorbing means comprises plate springs.

3. The improvement claimed in claim 1, wherein each said shock absorbing means comprises two opposed plate springs.

4. The improvement claimed in claim 1, comprising two pairs of said shock absorbing means.

5. The improvement claimed in claim 1, wherein said bearing member comprises an elongate member having opposite ends, and said means for attaching comprises plural connecting bolt means attaching said opposite ends of said bearing member to said supporting device, said shock absorbing means being positioned between said connecting bolt means in the longitudinal direction of said bearing member.

6. The improvement claimed in claim 1, further comprising pin means for mounting said shock absorbing means to said supporting device.

7. The improvement claimed in claim 1, wherein said attaching means comprises connecting bolt means, extending through said shock absorbing means.

8. The improvement claimed in claim 1, further comprising a cover holder mounting said cover to said shaft, said cover holder having abutment means for contacting said bearing member upon opening of said cover.

9. The improvement claimed in claim 1, wherein said supporting device comprises plural ribs integral with and extending from said riser corner element, and a supporting plate integral with said ribs.

10. The improvement claimed in claim 9, comprising three equally spaced said ribs.

11. The improvement claimed in claim 10, wherein said bearing member comprises an elongate member having opposite ends, and said means for attaching comprises pairs of connecting bolt means attaching said opposite ends of said bearing member to said supporting device at positions outwardly of outermost of said ribs, said shock absorbing means being positioned between said pairs of connecting bolt means.

12. The improvement claimed in claim 10, comprising a first shock absorbing means positioned approximately midway between first and second adjacent of said ribs.

13. The improvement claimed in claim 12, further comprising second shock absorbing means positioned approximately one-third the distance between a third of said ribs and said second rib, said second and third ribs being adjacent.

14. The improvement claimed in claim 10, wherein said bearing member has plural integral projections rotatably supporting said shaft.

15. The improvement claimed in claim 14, further comprising a counterweight and an impact weight mounted on one end of said shaft at a position outwardly of said projections, said counterweight being fixedly and non-rotatably attached to said shaft, said impact weight being rotatably mounted on said shaft, said counterweight having thereon stop means at a position to be contacted by said impact weight upon rotation of said impact weight about said shaft relative to said counterweight.

16. The improvement claimed in claim 14, comprising two pairs of said projections, two outermost of said projections being aligned with the two outermost of said ribs.

17. The improvement claimed in claim 16, further comprising a cover holder having a first end thereof connected to said cover and a second end thereof fixed to said shaft at a position between two innermost of said projections.

* * * * *